US005550615A

United States Patent [19]

Szlucha

[11] Patent Number: 5,550,615

[45] Date of Patent: Aug. 27, 1996

[54] TONER CONCENTRATION ADJUSTMENT METHOD AND APPARATUS

[75] Inventor: Thomas F. Szlucha, Fairport, N.Y.

[73] Assignee: Xerox Corporation, Stamford, Conn.

[21] Appl. No.: 334,904

[22] Filed: Nov. 7, 1994

[51] Int. Cl.[6] ..... G03G 21/00

[52] U.S. Cl. ..... 355/208; 355/246

[58] Field of Search ..... 355/208, 205, 355/207, 246; 118/689, 693

[56] References Cited

U.S. PATENT DOCUMENTS

| | | | |
|---|---|---|---|
| 4,434,221 | 2/1984 | Oka | 430/122 |
| 4,492,179 | 1/1985 | Folkins et al. | 118/689 |
| 4,619,522 | 10/1986 | Imai | 355/246 |
| 4,847,659 | 7/1989 | Resch, III | 355/246 X |
| 4,974,024 | 11/1990 | Bares et al. | 355/246 |
| 5,245,389 | 9/1993 | Yoshiyama et al. | 355/246 |
| 5,305,059 | 4/1994 | Kurosawa | 355/208 |
| 5,387,965 | 2/1995 | Hasegawa et al. | 355/246 |

*Primary Examiner*—Robert Beatty
*Attorney, Agent, or Firm*—Tallam I. Nguti

[57] ABSTRACT

A method and apparatus for minimizing operator manual adjustments for toner concentration drifts in a printing machine. The method includes storing into a controller, a value for a toner concentration factor, and of estimating a quantity of toner to be depleted by each toner reproduction of a document sheet. The method also includes maintaining the toner concentration ratio by adding to a development housing a quantity of fresh toner, and of keeping a running count of toner reproductions of document sheets made. The method further includes manually adjusting the quantity of fresh toner added based on inspecting toner reproductions made, keeping a count of the number of such manual adjustments, and automatically correcting the stored value for the toner concentration factor, when the number of manual adjustments, relative to a predetermined running count of toner reproductions, reaches a predetermined number.

25 Claims, 4 Drawing Sheets

TONER CONCENTRATION ADJUSTMENT METHOD AND APPARATUS

BACKGROUND OF THE INVENTION

This invention relates to printing machines, and more particularly to a method and apparatus for adjusting for toner concentration drifts in such a printing machine.

In electrostatographic copiers and printers, toner reproductions are made using toner particles, contained in developer material at a desired concentration level. As toner particles are depleted from the developer material, additional toner particles must be added thereto in order to maintain the toner concentration at the desired level. Typically, the toner concentration of a machine is monitored by suitable means, and is maintained by adding fresh toner particles to the development housing of the machine.

For monitoring and maintaining the toner concentration of such a machine, many types of systems including high cost toner concentration sensors, have been proposed. For example, U.S. Pat. No. 4,619,522 to Imai teaches the use of a reference pattern, with a predetermined reflectance, that is developed. Subsequently, the density of the developed pattern is detected by a sensor, and used to regulate the replenishment of toner to the developer housing.

Furthermore, U.S. Pat. No. 4,434,221 to Oka discloses a method of utilizing a reference latent image to measure the current flow between the developing sleeve and the photoreceptor drum during development of the reference image. Subsequently, the amount of toner needed for replenishment is controlled, based on the current value measured. Oka further characterizes this method as inferior, because, the variation in current value due to toner concentration is exceeded by the variation due to the amount of toner adhering to the reference image.

In addition, U.S. Pat. No. 4,492,179 to Folkins et al., teaches the sensing of the charge of the toner particles being transferred to the latent image, and means for controlling the addition of toner to the developer housing as a function of that measurement. Folkins et al. also discloses the limitations of the marking particle dispense control system, relating to toner dispensing assumptions, in which the rate of dispense must remain constant over the life of the system. More specifically, any variation in the toner mass dispensed for a given electrical input will manifest itself proportionally as a shift in the relationship between the toner dispense rate and the bias current required for the developed toner charge.

Unfortunately however, these proposed systems can each be prohibitively expensive particularly with respect to low volume printing machines. Ordinarily, each such low volume, low cost machine will tend to use a low cost toner concentration maintenance and control system. Such a low cost system, for example, can involve the estimation of an amount of toner to be depleted by each toner reproduction to be made, as well as, the automatic addition or replenishment, after reproduction, of an amount of fresh toner equal to the estimated depletion amount. However, because of the low cost nature of such a control system, and because of the potential for, and actual, errors both in estimation and replenishment of toner amounts, the actual toner concentration achieved may tend to drift one way or the other about a desired nominal level. This is because such errors or, variations tend to result in a higher or lower than expected average toner feed rate. The variations or errors in image area coverage sensing accuracy are due, for example, to effects of dirt accumulation on the sensor 31. All in all, it has been found that up to a 10% variation can occur in toner amounts fed. Such variations in toner feeding accuracy, as expected, tend to cause the machine to drift out of an acceptable toner concentration operating range, and thus result in copy quality deficiencies.

it is therefore common in such machines to enable an operator based on inspection of toner reproductions, to make manual adjustments to the amount of fresh toner actually added by the system. In such machines, errors in over feeding of toner are more damaging and harder for an operator to control than errors of under feeding toner. The control system may therefore be preferably and intentionally set to feed toner slightly on the low side, thereby causing the toner concentration of the machine to slowly drift downwards. When it eventually drifts too low, as judged by the operator from inspecting toner reproductions, the operator can press a "toner-add button" so as to add additional toner to boost the toner concentration back up. Equally however, a "toner-reduce button" can also be provided for manually reducing amounts of fresh toner that would otherwise be added automatically.

Such operator adjustments, however, can unfortunately make the problem worse by resulting in wider and varying drifts about the desired or nominal concentration level. In addition, frequent and too many, such adjustments by an operator can detrimentally affect perceived customer satisfaction with the performance of the machine, even if toner reproductions made following such adjustments are actually of acceptable quality.

There is therefore a need to provide a method and apparatus in such low volume, low cost machines for effectively controlling the toner concentration thereof while minimizing the number and frequency of such operator adjustments.

SUMMARY OF THE INVENTION

In accordance with one aspect of the present invention, there is provided in a printing machine using multiple component developer material in a development housing, and having a programmable controller, a method of minimizing operator adjustments for toner concentration drifts. The method includes the step of automatically dispensing fresh toner into the developer material housing in accordance with a control algorithm stored in the controller. The method also includes the step of manually adjusting a quantity of fresh toner added to the developer material in the development housing, so as to maintain the toner development quality at an acceptable level. Importantly, the method also includes the steps of sensing and keeping a count of the number of manual adjustments made to quantities of fresh toner added, and of automatically adjusting the stored algorithm when the number of manual adjustments, relative to a predetermined running count of toner reproductions, reaches a predetermined value.

In accordance with another aspect of the present invention, there is provided an apparatus for automatically minimizing operator adjustments for toner concentration drifts in a printing machine. The apparatus includes means for estimating a quantity of toner to be depleted from multiple component developer material in a development housing of the printing machine, and means for adding fresh toner to the development housing to maintain the toner concentration at a desired level. The apparatus also includes a controller storing an algorithm and connected to the estimating means and to the adding means, for controlling the functions and components of the machine. The controller includes memory means for storing the algorithm, and counting means for counting a number of operator adjustments and a number of toner reproductions made by the machine. The controller also includes means, responsive to the counted number of operator adjustments, and to the number of reproductions made, for automatically adjusting the stored algorithm for determining amounts of fresh toner to be added to the development housing so as to maintain the toner concentration thereof at a level for producing acceptable quality toner reproductions.

Other features of the present invention will become apparent from the following drawings and description.

BRIEF DESCRIPTION OF THE DRAWINGS

In the detailed description of the invention presented below, reference is made to,the drawings, in which.

DETAILED DESCRIPTION OF THE INVENTION

Figure 1A:
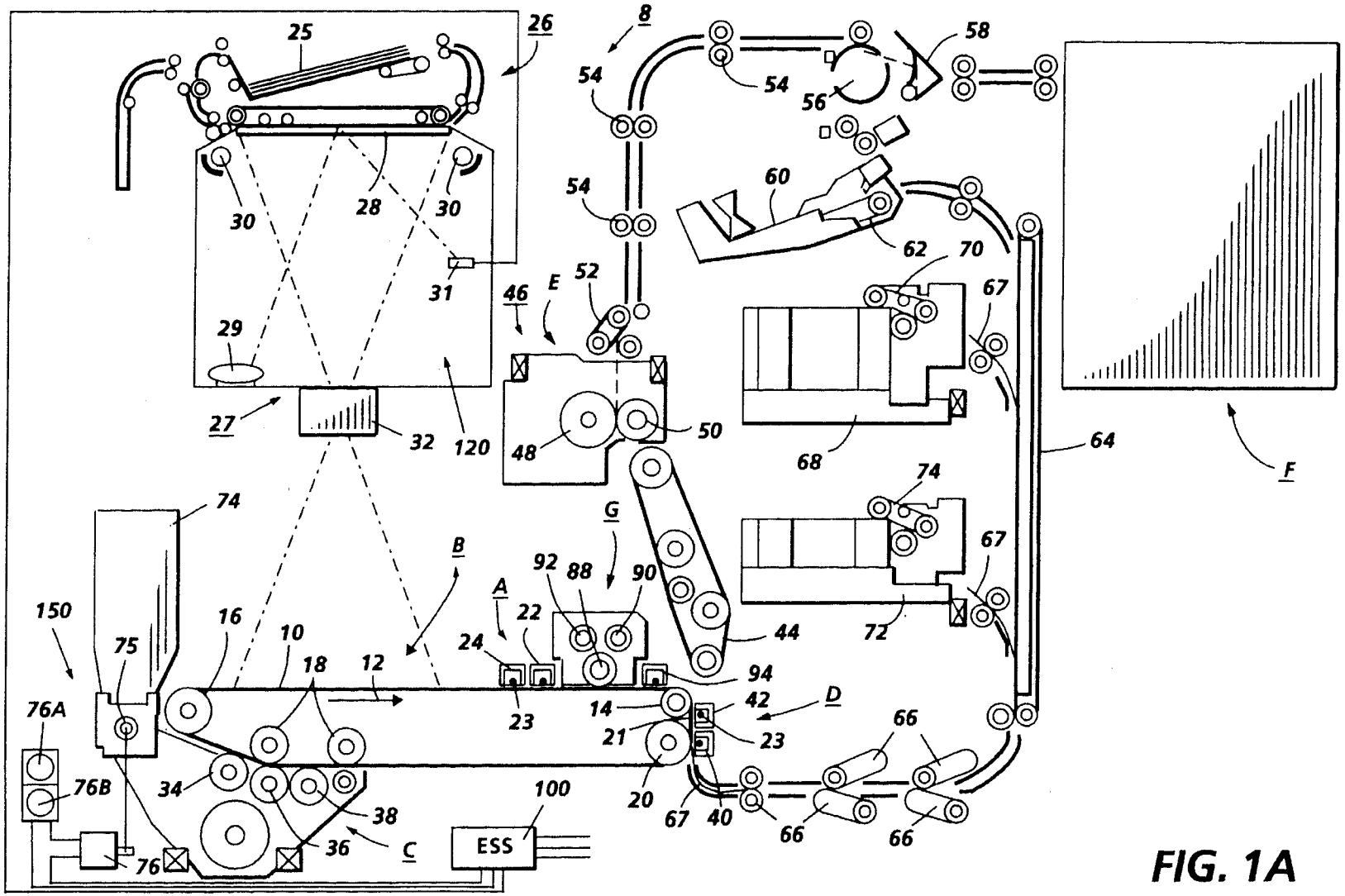
FIG. 1A is a schematic elevational view of a high volume printing machine including the toner concentration adjustment apparatus of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims, Referring now to FIG. 1A, an exemplary electrostatographic printing machine 8 of the present invention is shown employing a photoconductive member in the form of a belt 10. As is well known, the photoconductive member 10 can also be a rotatable drum. Belt 10 moves along a path in the direction of the solid line arrow 12 to advance successive portions thereof, sequentially through various processing stations disposed about the path of movement thereof. Belt 10 is entrained along the path by stripping roller 14, tensioning roller 16, idler roller 18, and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means, such as a belt drive. As roller 20 rotates, it advances belt 10 in the direction of arrow 12.

Initially, a portion of the photoconductive belt 10 passes through charging station A. At charging station A, two corona generating dicorotrons, indicated generally by the reference numerals 22 and 24 charge the photoconductive belt 10 to a relatively high, and substantially uniform potential. Dicorotrons 22, 24 (and 40, 42, and 90) each have a coronode 21 and shield 23. Dicorotron 22 places all of the required charge on photoconductive belt 10. Dicorotron 24 normally acts as a leveling device, and fills in any areas missed by dicorotron 22.

Next, the charged portion of the photoconductive belt 10 is advanced through imaging station B. At imaging station B, an optics cavity 27 has a transparent platen 28 on which sheet documents 25 to be copied are positioned. A document handling unit 26 is positioned over platen 28 sequentially feeds sheets of documents 25 from a stack of such sheets onto platen 28. After imaging each document sheet, the sheet is returned from platen 28 to the stack of document sheets. Flash lamps 30 in cavity 27 on each side of platen 28 illuminate the positioned document. Light rays reflected from the document are transmitted through suitable optics, shown here as a lens 32 in the bottom of optics cavity 27. Lens 32 focuses the light rays onto the charged photoconductive belt 10 to selectively and imagewise dissipate the charge in positions thereof. This records an electrostatic latent image on the photoconductive belt 10 which corresponds in shape and density to the informational areas contained within the illuminated document sheet. Thereafter, belt 10 advances the recorded electrostatic latent image to a development station C.

Development station C includes a developer housing 33 containing multiple component developer material that includes charged carrier particles, and charged toner particles at a desired concentration. The housing 33, for example, includes three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Developer roll 38 is a cleanup roll. The latent image attracts charged toner particles from the carrier particles or granules of the developer material in order to form a toner image on the photoconductive surface of belt 10. As is well known, formation or development of the latent image with toner particles as such, depletes or uses up a quantity of such toner particles from the developer material in the housing 33 thereby reducing the level of toner concentration thereof. Belt 10 then advances the toner image to transfer station D.

At transfer station D, a copy sheet 67 is fed into contact with the toner image on the surface of belt 10. First, photoconductive belt 10 is exposed to a pre-transfer light source (not shown) in order to reduce the charge attraction between photoconductive belt 10 and the toner image. Next, a dicorotron 40 charges the copy sheet 67 to the proper magnitude and polarity so that the copy sheet 67 is tacked to photoconductive belt 10 and the toner image is transferred when attracted from the photoconductive belt 10 to the copy sheet. After such transfer, a corona generator 42 charges the copy sheet 67 to the opposite polarity to detack the copy sheet from belt 10. Conveyor 44 then advances the copy sheet to fusing station E.

As shown, fusing station E includes a fuser assembly, indicated generally by the reference numeral 46, which heats and permanently affixes the transferred toner image to the copy sheet 67. Preferably, fuser assembly 46 includes a heated fuser roller 48 and a pressure roller 50 with the toner image on the copy sheet contacting heated fuser roller 48. The pressure roller is cammed against the fuser roller to provide the necessary pressure to fix the heated toner image to the copy sheet. The fuser roll 48 is internally heated for example by a quartz lamp. After fusing, the copy sheet 67 may be fed through a decurler 52. Decurler 52 bends the copy sheet in one direction to put a known curl in the copy sheet and then bends it in the opposite direction to remove that curl.

When doing duplex, forwarding rollers 54 advance the sheet 67, a simplex sheet, to duplex turn roll 56. A solenoid gate 58 diverts the sheet into duplex tray 60. The simplex sheets in tray 60 are then fed, in seriatim, by bottom feeder 62 from tray 60 back to transfer station D via conveyor 64 and rollers 66 for transfer of the toner image to the second and opposite side of each copy sheet. Otherwise, duplex solenoid gate 58 guides the simplex or duplex sheet to a finishing station F. At finishing station F, copy sheets are stacked in a compiler tray and may be bound to one another to form sets.

As shown, copy sheets 67 are fed to the transfer station D for example from sheet supply trays 68 and 72. Each of the trays 68, 72 for example includes an elevator for raising and lowering the tray. When the tray is in the down position, stacks of copy sheets can be loaded thereinto or unloaded therefrom. In the up position, successive copy sheets may be fed therefrom by sheet feeder 70, 74. Sheet feeder 70, 74 as shown, for example, is a friction retard feeder utilizing a feed belt and take-away rolls to advance successive copy sheets to transport 64 which then advances the sheets to rolls 66 and to transfer station D.

Invariably, after the copy sheet is separated from the photoconductive belt 10, some residual particles remain adhering thereto. Therefore, after image transfer, photoconductive belt 10 passes beneath dicorotron 94 which charges the residual toner particles to the proper polarity. Thereafter, light from a lamp (not shown) is impinged on belt 10 to discharge the photoconductive belt in preparation for the next charging cycle. Residual particles are then removed from the photoconductive 10 at cleaning station G. Cleaning station G, for example, includes an electrically biased cleaner brush 88 and two de-toning rolls 90 and 92, which function as waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

Figure 1B:
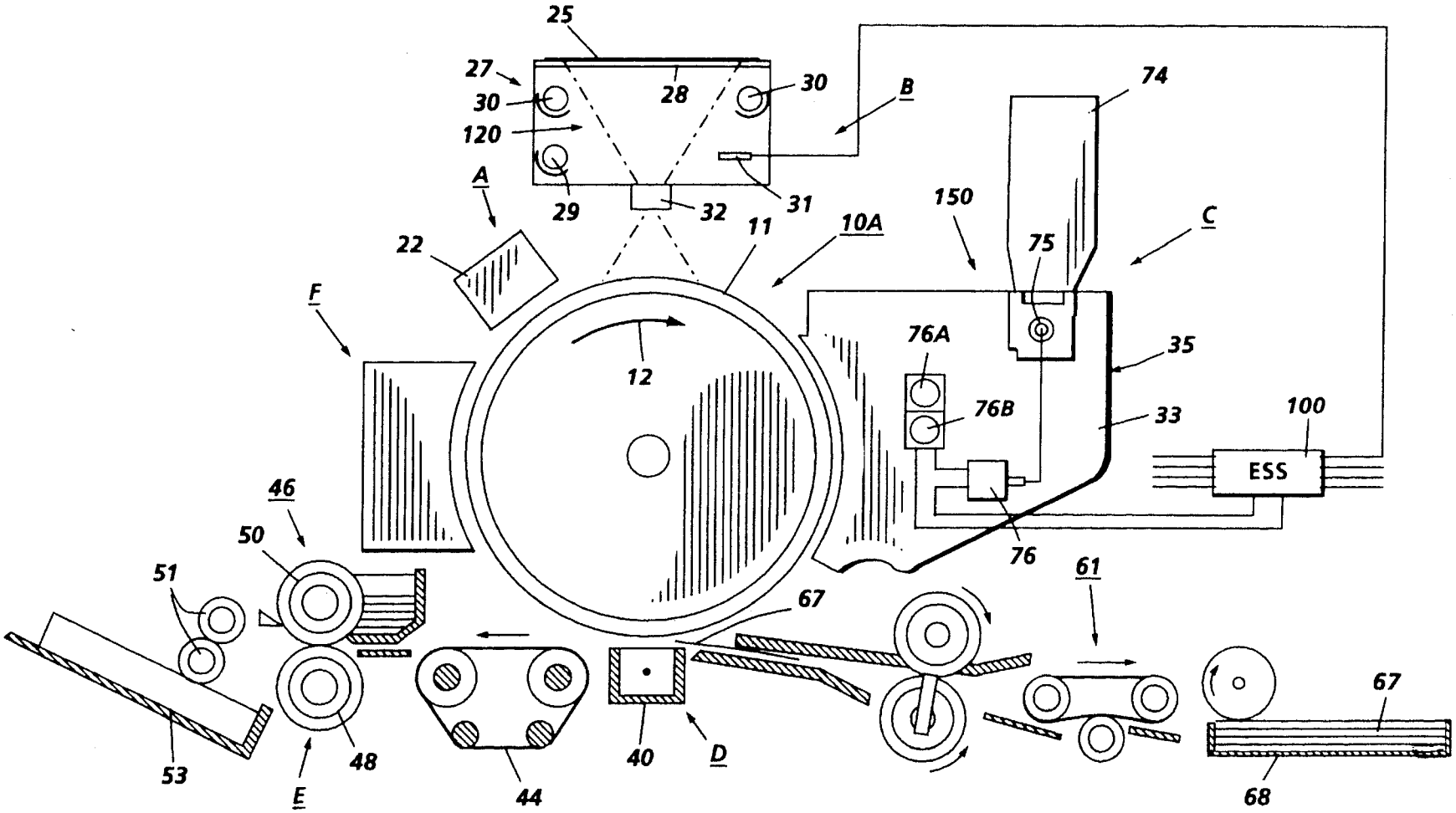
FIG 1B is a schematic elevational view of a low volume printing machine incorporating including the toner concentration adjustment apparatus of the present invention.

Referring now to FIG. 1B wherein like numerals refer to like elements as in FIG. 1A, another embodiment of an electrostatographic printing machines, such as a low volume machine incorporating the present invention, is illustrated. The printing machine as shown includes a photoconductive drum 10A having a photoconductive surface 11. Drum 10A is rotated by means (not shown) in the direction of arrow 12 through various processing stations.

Initially, drum 10A rotates a portion of photoconductive surface 11 through charging station A. Charging station A employs a conventional corona generating device 22, to charge photoconductive surface 11 to a relatively high substantially uniform potential.

hereafter drum 10A rotates the charged portion of photoconductive surface 11 to exposure station B. Exposure station B includes an optics cavity 27, having a stationary, transparent platen, such as a glass plate 28 for supporting an original document 25 thereon. Flash lamps 30 illuminate the original document 25 so as to create reflected light images of the original which are projected through a lens assembly 32 and onto the charged portion of photoconductive surface 11.

Drum 10A then rotates the recorded electrostatic latent image to development station C. Development station C includes a developer unit 35, having a housing 33 with a supply of developer mix contained therein. At the development station C the electrostatic latent image is developed by bringing a brush of developer mix into contact therewith.

With continued reference to Figure 1B, a copy sheet 67 is advanced from a sheet supply 68 to a transfer station D. As shown, sheet 67 is advanced by a sheet feeding apparatus 61 through a sheet registration roller assembly 61A to the transfer station D. Transfer station D for example includes a corona generating device 40 which applies a spray of ions to the back side of the copy sheet 67. This attracts the toner powder image from photoconductive surface 11 to copy sheet.

After transfer of the toner powder image to the copy sheet, the sheet is advanced by endless belt conveyor 44, to fusing station E. including a fuser assembly 46. Fuser assembly 46 includes a fuser roll 48 and a backup roll 50 defining a nip therebetween through which the copy sheet passes. After the fusing process is completed, the copy sheet is advanced by rollers 51 to catch tray 53.

Invariably, after the copy sheet is separated from photoconductive surface 11, some residual toner particles remain adhering thereto. These toner particles are removed from photoconductive surface 11 at cleaning station G. Cleaning station G includes a corona generating device (not shown) adapted to neutralize the remaining electrostatic charge on photoconductive surface 11 and that of the residual toner particles. The neutralized toner particles are then cleaned from photoconductive surface 11 by a rotatably mounted fibrous brush (not shown) in contact therewith. Subsequent to cleaning, a discharge lamp (not shown) floods photoconductive surface 11 with light to dissipate any residual electrostatic charge remaining thereon prior to the charging thereof for the next successive imaging cycle.

In the above described process of each machine, the development of a latent image with toner, depletes or uses up an amount of toner contained in the multicomponent developer material in the development housing 33. As is known, the amount or quantity of toner remaining in the housing 33 determines the toner concentration of the developer material therein and hence of the machine. As is also well known, the toner concentration of a machine is critical for the machine's ability to produce acceptable quality toner reproductions of images of document sheets.

As illustrated in FIGS. 1A, 1B, the various machine functions and stations described above, as well as its toner concentration maintenance system (to be described below), are regulated by a controller shown generally as 100. The controller 100 preferably includes a programmable microprocessor storing control algorithms and coupled, for example, to conventional control switch inputs from the various stations and components, and from an operator console. Conventional sheet path sensors or switches, for example, may be utilized to keep track of the number of document sheets, and of the toner reproduction or copy sheets. In addition, the controller 100 can also perform calculations from such sensor inputs as well as from stored values, and it can control the machine, as above, on the basis of such calculations.

Still referring to FIGS. 1A, 1B, the toner concentration adjustment apparatus shown generally as 120, 150 according to the present invention is illustrated and is suitable for maintaining the toner concentration of developer material in the development housing 33, and for minimizing a number of operator manual adjustments to drifts in such toner concentration. The apparatus 120, 150 includes means shown generally as 120, including the controller 100, for estimating a quantity of toner to be depleted from multiple component developer material in the development housing 33. As shown, the means 120 includes a light source such as the inprocess flash lamps 30, or as illustrated, a small preflash lamp 29 disposed adjacent the bottom of optics cavity 27 for pre-exposing the document 25 on platen 28 prior to in-process exposure of the image by flash lamps 30 as described above. A suitable photosensor 31 senses the intensity of the preexposure light of lamp 29 as reflected from platen 28 and from the document 25 thereon, and generates an electrical output signal. The photosensor 31 is such that the electrical output signal so generated is proportional to the density of an image on the exposed surface of the document sheet 25, as well as to a degree to which such image covers such surface area of the document sheet 25. The electrical output signal of sensor 31 is fed, as shown, to the controller 100 for use in estimating a quantity of toner to be depleted by a toner reproduction of the image of the document sheet 25.

As also illustrated, the apparatus 120, 150 for automatically minimizing operator adjustments for toner concentration drifts also includes means shown generally as 150 for adding fresh toner particles to the development housing 33. The means 150 includes a source, for example, a hopper 74 of fresh toner particles, and a movable toner feeding means 75, such as a rotatable auger, that is connected to the hopper 74 for feeding fresh toner particles from the hopper 74 into the development housing 33. The movable toner feeding means or auger 75 is drivable by a motor 76, for example. As illustrated, the motor 76 is connected to the controller 100 for preprogrammed and automatic movement thereof in accordance with an algorithm implementing the method of the present invention. Such automatic movement is carried out after toner development of latent images, and for feeding a desired quantity of fresh toner particles to the development housing 33. For such movement, the auger 75 may be rotated at a predetermined constant speed for a calculated value equal to a time period, or equal to a number of auger revolutions. Driving or moving the auger for such a value dispenses a desired quantity of fresh toner particles to be added to the housing 33.

When the desired quantity of fresh toner particles is added automatically following production of a toner reproduction of a sheet document, such a desired quantity according to the present invention is ordinarily equal to the quantity of depletion toner estimated for the particular sheet document using the electrical output signal thereof, and the stored toner concentration factor. The method of the present invention includes intentionally adding to the multiple component developer material in the development housing a quantity of fresh toner that is less than the quantity estimated, in order to prevent errors in over feeding of toner which are more damaging and harder for an operator to control. One objective of the present invention is therefore to automatically adjust the toner concentration factor so as to arrive at automatically dispensed toner quantities that, without manual adjustments, are equal to desired increased or desired decreased toner quantities following image quality inspections.

As further shown, the means 150 for adding fresh toner particles to the development housing 33 also includes a first manual switch or button 76A that is connected to the driving means or motor 76 for controlling the auger 75 so as to increase the quantity of fresh toner that would have been added automatically to the development housing 33, to a quantity greater than the estimated quantity of depletion toner. Activating the first adjustment switch 76A, for example, will move the toner feeding auger 75 for a movement value, which may be expressed in seconds or in revolutions, that is greater than the stored nominal value thereof for automatically adding toner. Such a stored nominal value is, or is calculated using, the stored toner concentration factor. The net result is to add a desired increased quantity of fresh toner particles to the development housing 33. The means 150 may also include a second manual switch or button 76B that is connected to the motor 76 for manually controlling the auger 75 so as to decrease the desired quantity of fresh toner that would have been added automatically to the development housing 33, to a quantity less than the estimated quantity of depletion toner. This can be achieved, as above, by moving the toner feeding auger for a movement value (in seconds or in revolutions) that is less than the stored nominal value thereof for automatically adding toner.

As discussed above, the apparatus 120, 150 for automatically minimizing operator adjustments for toner concentration drifts also includes the controller 100 which is connected to the estimating means 120, and to the adding means 150. The controller 100 for example includes reading means, and memory means for storing a control algorithm including the toner concentration factor which it uses with the electrical output signal of the means 120 in estimating depletion toner amounts, or in determining toner replenishment values (Tc in seconds or revolutions). The controller 100 also includes counting means for counting a number of operator adjustments made by means of the switches or buttons 76A, 76B. The counting means is also used for providing a number of toner reproductions made by the machine. The controller further includes means, responsive to the counted number of operator adjustments, and to the number of reproductions made, for automatically adjusting the stored algorithm, for example, by automatically changing the value of the stored toner concentration factor to be used in estimating the quantities of toner depleted, or in estimating a toner replenishment value (Tc),thereby determining desired quantities of fresh toner to be added to the development housing in order to maintain the quality of toner reproductions at an acceptably high level.

Figure 2A:
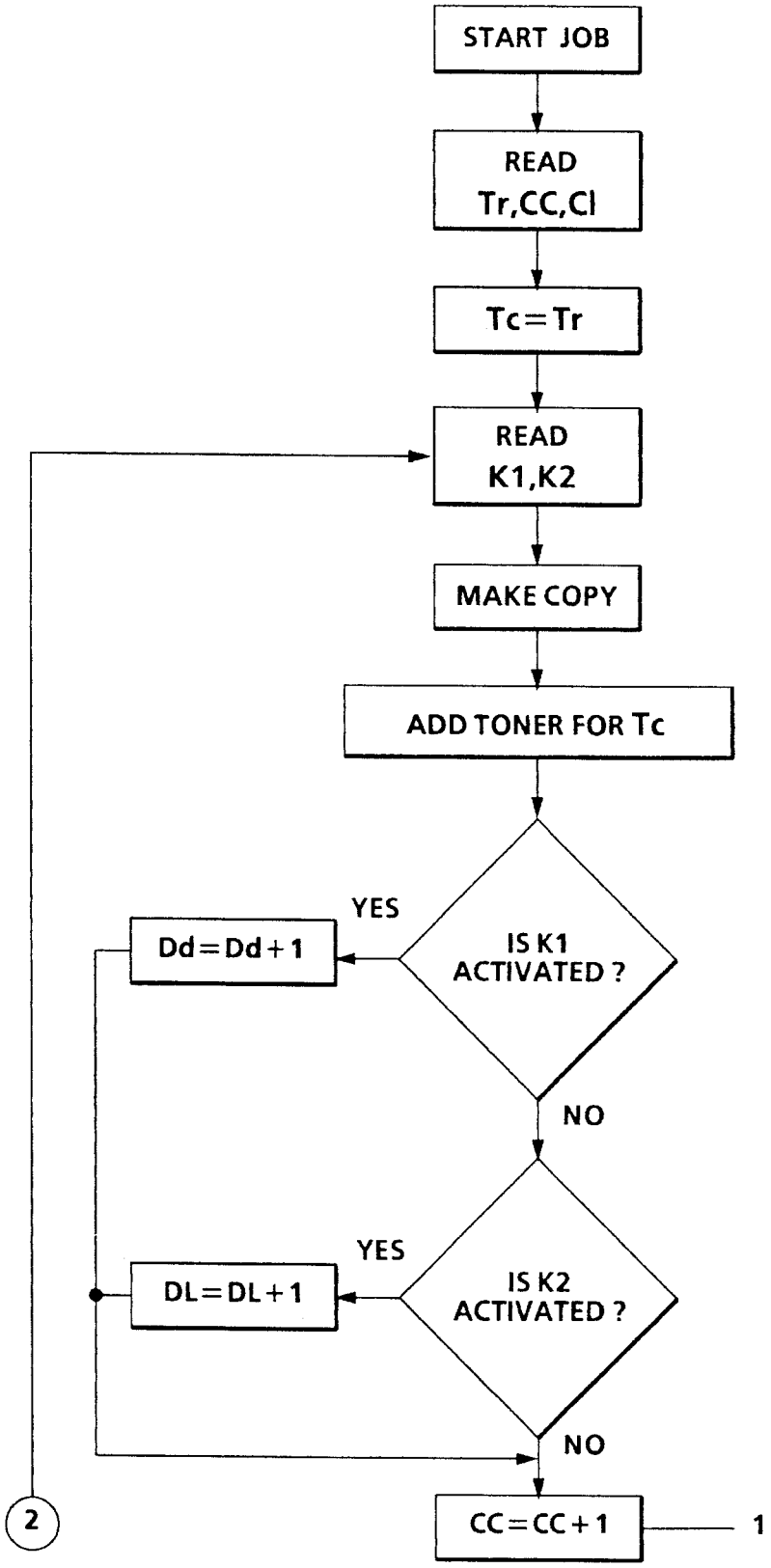
FIGS. 2A and 2B flow diagrams illustrating the method of the present invention.
Figure 2B:
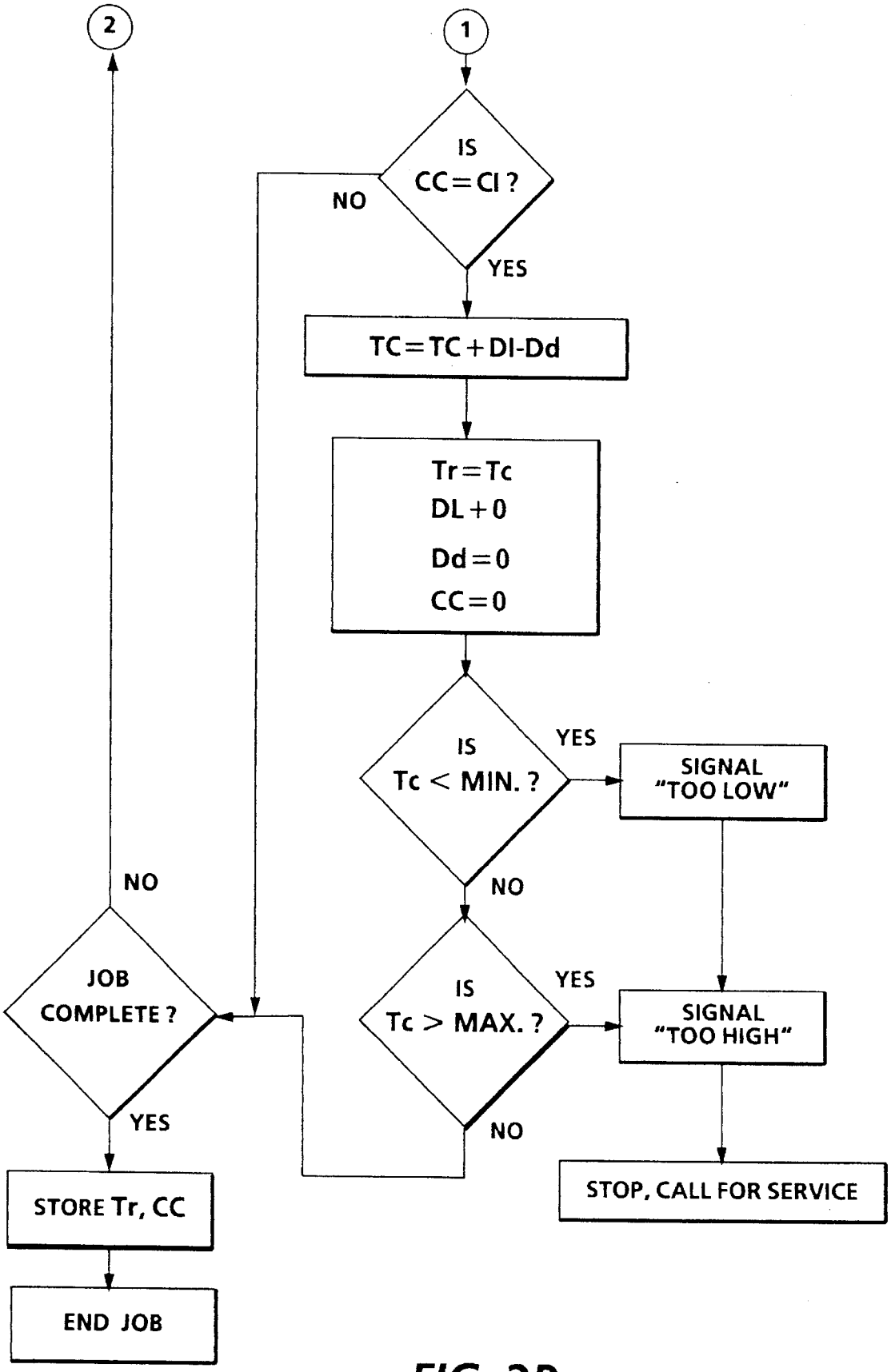

Referring now to FIGS. 2A and 2B, one approach to the method of automatically minimizing operator adjustments for toner concentration drifts in the printing machine 8 is illustrated. As illustrated, CC is copy count since last manual adjustment; CI is a predetermined number of copies that are expected to be made without a manual adjustment; Tr is a nominal or baseline value for toner dispensing by auger 75, while Tc is a current value for same. K1 is a "toner-add button" push or pushes, and K2 is an occurrence of "toner-reduce button" push or pushes. DL is a predetermined automatic correction factor for increasing Tc, and Dd is same for decreasing Tc. Max. and Min. are the upper and lower safety limits for correcting Tc in the particular machine.

The method includes the step (i) of reading from a memory of the controller 100 a toner dispensing factor or baseline value Tc (in seconds or revolutions) for an amount of fresh toner to be added to the development housing 33 per toner reproduction and (ii) of reading from the controller 100 an expected number Ci of toner reproductions that should be made by the machine without an operator manually adjusting for toner concentration drifts.

The method also includes the steps of making and judging or visually inspecting a toner reproduction of an original image, and of adjusting, by increasing or decreasing, an amount of fresh toner actually added. The step of inspecting a toner reproduction of a document sheet, for example, may consist of visually examining every toner reproduction of a document sheet for toner development quality. Alternatively, the step of inspecting a toner reproduction of a document sheet may consist of visually inspecting only a first toner reproduction of a set of toner reproductions making up a reproduction job. Furthermore, the step of inspecting a toner reproduction of a document sheet may consist of visually inspecting only every "nth" toner reproduction in a series of greater than "n" reproductions making up a reproduction job.

The method also includes the step of manually adjusting, based on the results of the inspecting step, the quantity of toner actually added. The adjusting is accomplishes by activating an "toner-add button" or a "toner-reduce button" to increase or decrease respectively, the amount of toner that would have been added automatically without such adjustment.

The method of the present invention further includes the steps of keeping a running count of toner reproductions made since a last manual adjustment, and of automatically correcting, by decreasing or increasing the magnitude of the stored factor or baseline value for an amount of fresh toner to be added per toner reproduction, if a particular number of manual adjustments is reached before a running count CC of toner reproductions made has reached or exceeded the expected number CL of toner reproductions that should be made without an adjustment. Such an increase is achieved by adding a value of one unit of baseline to the stored baseline value, if the toner reproduction made is judged to be too light, or by subtracting a value of one unit of baseline from the baseline value if the image is judged to be too dark.

As further illustrated, the method of the present invention further includes a step of disenabling the making of toner reproductions by the machine 8 if the automatically corrected and stored factor or baseline value, for example Tc, for an amount of fresh toner to be added per toner reproduction reaches a programmed maximum, (Max.) value that is allowed or a programmed minimum, (Min.) value that is allowed for the machine.

It might also be useful to store and make the cumulative number of "button pushes" available to a service representative so that he or she can use it to diagnose the status of developer material life. An exceedingly high number of such button pushes may be indicative of developer material failure which can of course be corrected by the service representative.

It is, therefore, apparent that there has been provided in accordance with the present invention, a method and apparatus that fully satisfies the aims and advantages providing an effective low cost system for monitoring and controlling the toner concentration of the machine and for automatically minimizing operator adjustments to toner concentration drifts in the machine. In order to maintain customer satisfaction and yet avoiding uncorrected drifts in the toner concentration of the machine, the method and apparatus of the present invention provide for automatic upward adjustment of the stored nominal value or factor for determining amounts of toner to be added using the electrical signal value from the sensor 31. As such, the system of the present invention is self compensating by monitoring the number, or frequency, of times an operator pushes the add toner button 76A. When the number of such button pushes per a given number of copies exceeds a limit CL, the parameter Tc that controls the toner feed rate will be automatically updated.

While this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. A method of minimizing operator adjustments for toner concentration drifts in a printing machine using multiple developer material and having a programmable controller, the method comprising the steps of:

(a) automatically and intentionally dispensing into the development housing a quantity of fresh toner that is less than a quantity of depleted toner estimated in accordance with a control algorithm stored in the controller in order to prevent errors in over feeding of toner which are more damaging and harder for an operator to control;

(b) manually adjusting a quantity of fresh toner added to the developer material in the development housing so as to maintain acceptable toner development quality;

(c) sensing and keeping count of manual adjustments to quantities of fresh toner added; and (d) automatically adjusting the stored algorithm in the controller, when the number of manual adjustments relative to a predetermined running count of reproductions reaches a predetermined value.

2. The method of claim 1, wherein said step of automatically dispensing toner in accordance with the stored algorithm includes a step of storing into the controller a value for a toner concentration factor for the multiple component developer material in a development housing.

3. The method of claim 1, wherein said step of automatically dispensing toner in accordance with the stored algorithm includes a step of estimating a quantity of toner to be depleted by each toner reproduction of a document sheet, and adding a quantity of fresh toner to the multiple component developer material in response to the estimating step.

4. The method of claim 1, wherein said step of automatically dispensing toner in accordance with the stored algorithm includes keeping a running count of toner reproductions made of document sheets.

5. The method of claim 1, wherein said step of manually adjusting a quantity of fresh toner added to the developer material includes a step of inspecting a toner reproduction of a document sheet for toner development quality.

6. The method of claim 1, wherein said step of automatically dispensing fresh toner into the developer material housing in accordance with a control algorithm comprises moving a toner dispensing device a predetermined nominal value for adding such quantity of fresh toner to the development housing.

7. The method of claim 1, wherein said step of manually adjusting a quantity of fresh toner added to the development housing comprises activating a first adjustment switch to move a toner dispensing device for a value greater than a nominal value calculated from a toner concentration factor, so as to add an increased quantity of fresh toner to the development housing.

8. The method of claim 1, wherein said step of manually adjusting a quantity of fresh toner added to the development housing comprises activating a second adjustment switch to move a toner dispensing device for a value less than a nominal value calculated from a stored toner concentration factor, so as to add a reduced quantity of toner to the development housing.

9. The method of claim 1, wherein said step of automatically adjusting the stored algorithm in the controller comprises a step of automatically increasing the value of a toner concentration factor stored in the controller.

10. The method of claim 3, wherein said step of estimating a quantity of toner depleted by each toner reproduction of a document sheet comprises exposing the document sheet to a source of light and to a light sensor; and generating an electrical signal from said light sensor proportional to a degree of toner coverage of the area of the exposed document sheet.

11. The method of claim 6, wherein said step of automatically dispensing toner in accordance with the algorithm comprises moving a toner dispensing device a predetermined nominal time period for adding such quantity of fresh toner to the development housing.

12. The method of claim 6, wherein said step of automatically dispensing toner in accordance with the algorithm comprises moving a rotatable toner dispensing auger a predetermined nominal number of revolutions for adding such quantity of fresh toner to the development housing.

13. Apparatus for automatically minimizing operator adjustments for toner concentration drifts in a printing machine producing toner developed reproductions of images on sheet documents, the apparatus comprising:

(a) means for estimating a quantity of toner to be depleted from multiple component developer material in a development housing of the printing machine;

(b) means for automatically and intentionally adding into the development housing a quantity of fresh toner that is less than the quantity of toner estimated to be depleted in order to maintain toner concentration in the development housing at a desired level;

(c) a controller connected to said estimating means and to said adding means, said controller including:

(i) counting means for counting a number of operator adjustments made on said adding means, and for counting a number of toner reproductions made;

(ii) means for controlling a stored toner dispensing factor for determining a quantity of fresh toner to be added to the development housing in response to toner reproductions made; and (iii) means, responsive to the counted number of operator adjustments and to the number of toner reproductions made, for automatically changing the value of the stored toner dispensing factor, when the number of operator adjustments relative to a predetermined count of toner reproductions reaches a predetermined value.

14. The apparatus of claim 13 wherein said means for estimating a quantity of toner to be depleted includes a source of light for exposing an area of a document sheet, and a light sensor generating an electrical signal proportional to a degree of image coverage of the document sheet.

15. The apparatus of claim 13 wherein said means for adding fresh toner includes a source of fresh toner and a movable feeding means connected to said source of fresh toner for feeding fresh toner to the development housing.

16. The apparatus of claim 14 wherein said light sensor comprises a light sensor generating an electrical signal proportional to the degree of image coverage of the exposed area, and to the density of the image on the exposed area of the document sheet.

17. The apparatus of claim 14 wherein said light sensor is connected to said controller.

18. The apparatus of claim 15 wherein said movable feeding means comprises a rotatable auger and means for driving said auger.

19. The apparatus of claim 15 including a driving means connected to said movable feeding means and to said controller for automatically moving said movable feeding means to feed a desired quantity of fresh toner to the development housing.

20. The apparatus of claim 19 including a first manual switch connected to said driving means for manually controlling said moving means to increase the quantity of fresh toner that would have been added automatically to the development housing.

21. The apparatus of claim 19 further including a second manual switch for controlling said moving means to decrease the quantity of fresh toner that would have been added automatically to the development housing.

22. A method of automatically minimizing operator adjustments for toner concentration drifts in a printing machine having a programmable controller and using multiple component developer material including toner, the method comprising the steps of:

(a) reading from a memory of the controller (i) a baseline value for an amount of fresh toner to be added per toner reproduction to a development housing holding the multiple component developer material, and (ii) an expected number of toner reproductions that should be made by the machine without an adjustment for toner concentration drifts;

(b) making and judging the toner development quality of a toner reproduction of an original image;

(c) manually adjusting, by increasing, an amount of fresh toner actually added to the development housing when the toner reproduction made is judged to be too light;

(d) keeping a running count of toner reproductions made since a last manual adjustment; and (e) automatically correcting, by increasing, the magnitude of said stored baseline value for automatically adding an amount of fresh toner per toner reproduction, when said adjusting by increasing step occurs before said running count of toner reproductions made exceeds said expected number of toner reproductions that should be made without an adjustment.

23. The method of claim 22, wherein said step of reading from a memory of the controller comprises reading a baseline time value for running a fresh toner dispensing unit so as to add fresh toner to the development housing.

24. The method of claim 22, including a step of disenabling the making of toner reproductions by the machine when the automatically corrected and stored value for automatically adding an amount of fresh toner per toner reproduction reaches a programmed maximum value allowed or a programmed minimum value allowed for the machine.

25. The method of claim 22 wherein said manually adjusting step comprises manually adjusting, by decreasing, an amount of fresh toner actually added to the development housing when the toner reproduction inspected is judged to be too dark, and said baseline value correcting step comprises automatically decreasing the magnitude of said baseline value.

* * * * *